US006929586B2

(12) United States Patent
Johnson

(10) Patent No.: US 6,929,586 B2
(45) Date of Patent: Aug. 16, 2005

(54) BALANCE AND GAIT TRAINING BOARD

(76) Inventor: Reginald A. Johnson, 3601 9th St., Meridian, MS (US) 39301

( * ) Notice: Subject to any disclaimer, the term of this patent is extended or adjusted under 35 U.S.C. 154(b) by 70 days.

(21) Appl. No.: 10/194,307

(22) Filed: Jul. 15, 2002

(65) Prior Publication Data

US 2004/0009845 A1 Jan. 15, 2004

(51) Int. Cl.[7] ..... A63B 3/00; A63B 22/00
(52) U.S. Cl. ..... 482/41; 482/51; 482/23
(58) Field of Search ..... 482/23, 35, 38, 482/40–42, 51; 434/250, 255, 258

(56) References Cited

U.S. PATENT DOCUMENTS 2,239,200 A * 4/1941 Peterson ..... 473/420
2,913,835 A * 11/1959 Montine ..... 434/250
3,747,233 A * 7/1973 Berryman ..... 434/255
4,988,092 A * 1/1991 Trout ..... 482/51
5,924,960 A * 7/1999 Cohen ..... 482/51
6,168,548 B1 * 1/2001 Fleming ..... 482/23
6,387,013 B1 * 5/2002 Marquez ..... 482/23
2001/0034288 A1 * 10/2001 Howlett-Campanella ..... 482/23

* cited by examiner

*Primary Examiner*—Gregory L. Huson
*Assistant Examiner*—Fenn C. Mathew
(74) *Attorney, Agent, or Firm*—Amelia B. Yarbrough

(57) ABSTRACT

A balance and Gait Training Board which adapts well within an existing parallel bar system which includes a board having a right half section and left half section being symmetrical to each other, each half section having a longitudinal inner border and a longitudinal outer border; the longitudinal outer border having an upstanding wall with predetermined transverse spaced slots on its upper surface for securely positioning flippable hurdles; a board is formed when the longitudinal inner borders of the tow half sections are aligned and integrally connected; wherein the board has spaced intervals markings patterned for gait assessment on its upper surface with or without printed numeral values for the markings. A plurality of flippable hurdles are positioned and repositioned to adjusted the stepping heights and stepping lengths. The two half sections forming the board are reversed and the balance beam is formed when the longitudinal outer borders of the two half sections are aligned and integrally connected.

6 Claims, 5 Drawing Sheets

BALANCE AND GAIT TRAINING BOARD

BACKGROUND OF THE INVENTION

This invention relates generally to the field of ambulatory devices for sensory integration, movement, positioning, exercise and play and more specifically to a Balance And Gait Training Board.

One of the most incapacitating aspects of numerous neurological and musculoskeletal disorders is the loss of the ability to ambulate. Posture, balance, and coordination are the three main mechanism for having the ability to move from place to place. When an individual's ability to walk with normal patterns is impaired, balance and gait training is one of the most constructive form of therapeutic active care. Balance and gait training can improve strength, fitness, flexibility and endurance.

Balance and gait training has been a very effective therapy for treating various conditions such as low back pain, neck pain, cervicobrachial syndromes, ankle and knee instability and osteoarthritis. Balance and gait training involves training the individual in proper foot position and aiding reflex balance responses, which are incorporated into a rehabilitation program.

The function of the toes, foot, ankle, calf, knee, thigh, hip, pelvis, torso, and upper extremities are the six major considerations of gait training. Effective monitoring of these functions using observational gait analysis usually involves standing alignment, walking (heel-strike, early stance, midstance, late stance and swing), walking up and down stairs I walking on even and uneven surfaces. Gait parameters, kinematics, and kinetics are three well known variables selected for analysis. Velocity, stride length, and cadence are commonly used for gait parameters analysis. Dorsiflexion during initial contact, maximum dorsiflexion in stance, and maximum plantarflexion in swing are commonly used for gait kinematics analysis. Peak power absorption, peak power generation are commonly for gait kinetics analysis.

Numerous therapeutic exercise and training devices are disclosed in the prior art. The following exemplary patents describe various types of these devices.

U.S. Pat. No. 5,924,960 discloses a therapeutic exercise apparatus comprising a flat platform and two parallel handrails with ladder steps or balance beam.

U.S. Pat. No. 4,105,201 discloses a balance beam comprising an elongate body having ends that lock in various positions which are selected by axially rotating the body and fixing the ends.

U.S. Pat. No. 5,334,121 discloses an interchangeable/adjustable hurdle having a collection of interchangeable parts.

U.S. Pat. No. 5,842,954 discloses a jumping training device comprising ladder-like elements.

U.S. Pat. No. 5,616,102 discloses foldable balance beam comprising a first and second beam portions.

U.S. Pat. Nos. 201,328, 5,536,222, 5,913,283 and 5,527,242 disclose exercise/training device comprising a base(s) and legs having a plurality of longitudinally spaced open slots/notches for positioning a rod.

BRIEF SUMMARY OF THE INVENTION

The primary object of the invention is to provide a board that is adaptable to most existing parallel bar systems.

Another object of the invention is to provide a board that allows for variable placements of hurdles whose height can be adjusted by merely flipping the hurdles.

Another object of the invention is to provide a board that easily converts to a safe, efficient and effective balance beam.

A further object of the invention is to provide a board that is simple and uncomplicated which can be used for roughly assessing step length, heel width, and forefoot angulation "at a glance".

Still another object of the invention is to provide a board that supports a transposable ambulation cushion, which also makes walking more challenging for ambulatory patients and effectively enhance balance skills and leg strength.

Still yet another object of the invention is to provide a board that is portable and adjustable suitable for physical therapy treatment in the home, as well as, in a clinic to provide a board that can be used with a wide range of impairments and varied levels of severity affecting ambulation.

Another object of the invention is to provide a board that can be used for teaching and evaluating adults and children.

Another object of the invention is to provide a board that is easily transported and stored.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

In accordance with a preferred embodiment of the invention, there is disclosed a Balance and Gait Training Board which adapts well within an existing parallel bar system comprising a board having a right half section and left half section being symmetrical to each other, each half section having a longitudinal inner border and a longitudinal outer border; said longitudinal outer border having an upstanding wall with predetermined transverse spaced slots on its upper surface for securely positioning flippable hurdles; wherein the longitudinal inner borders of the two half sections are aligned and integrally connected by coupling means to form the board; said board having spaced intervals markings patterned for gait assessment on its upper surface; A plurality of flippable hurdles which can be positioned and repositioned to adjust the stepping heights and stepping lengths; and wherein said two half sections forming said board are reversed and said longitudinal outer borders of said two half sections are aligned and integrally connected by coupling means to form a balance beam.

The drawings constitute a part of this specification and include exemplary embodiments to the invention, which may be embodied in various forms. It is to be understood that in some instances various aspects of the invention bay be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
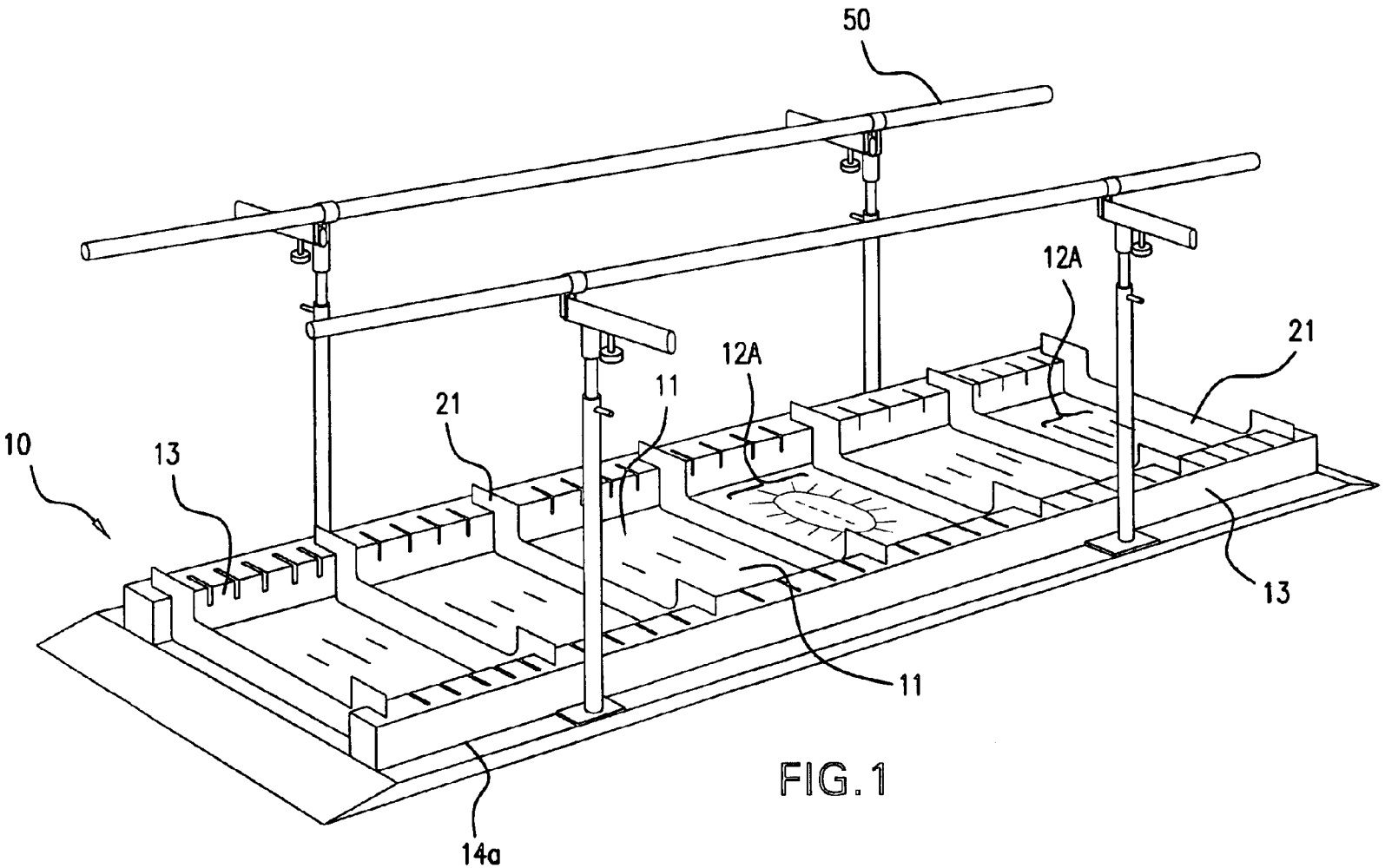
FIG. 1 is a perspective view of the Balance and Gait Training Board with hurdles in the two inch position within an existing parallel bar system.

In accordance with the present invention, FIG. 1 is a perspective view of the Balance and Gait Training Board (unitary board) 10, comprising an elongated rectangular platform having a right half section 11 and left half section 11 which are aligned and in conforming elation to each other. Each half section 11 has an upstanding wall 13 on its longitudinal outer border 14a for engaging flappable ambulation hurdles 21. Each upper surface of half section 11 has symmetrical foot placement gait assessment pattern 12A. The board 10 may be made from any slip-resistant durable material such wood. An example of such material for the board 10 is oak coated with a natural acrylic protective shield coating. The length of the board 10 may vary, for example, eight to ten feet is suitable and adapts well within existing parallel bar systems 50.

Figure 2A:
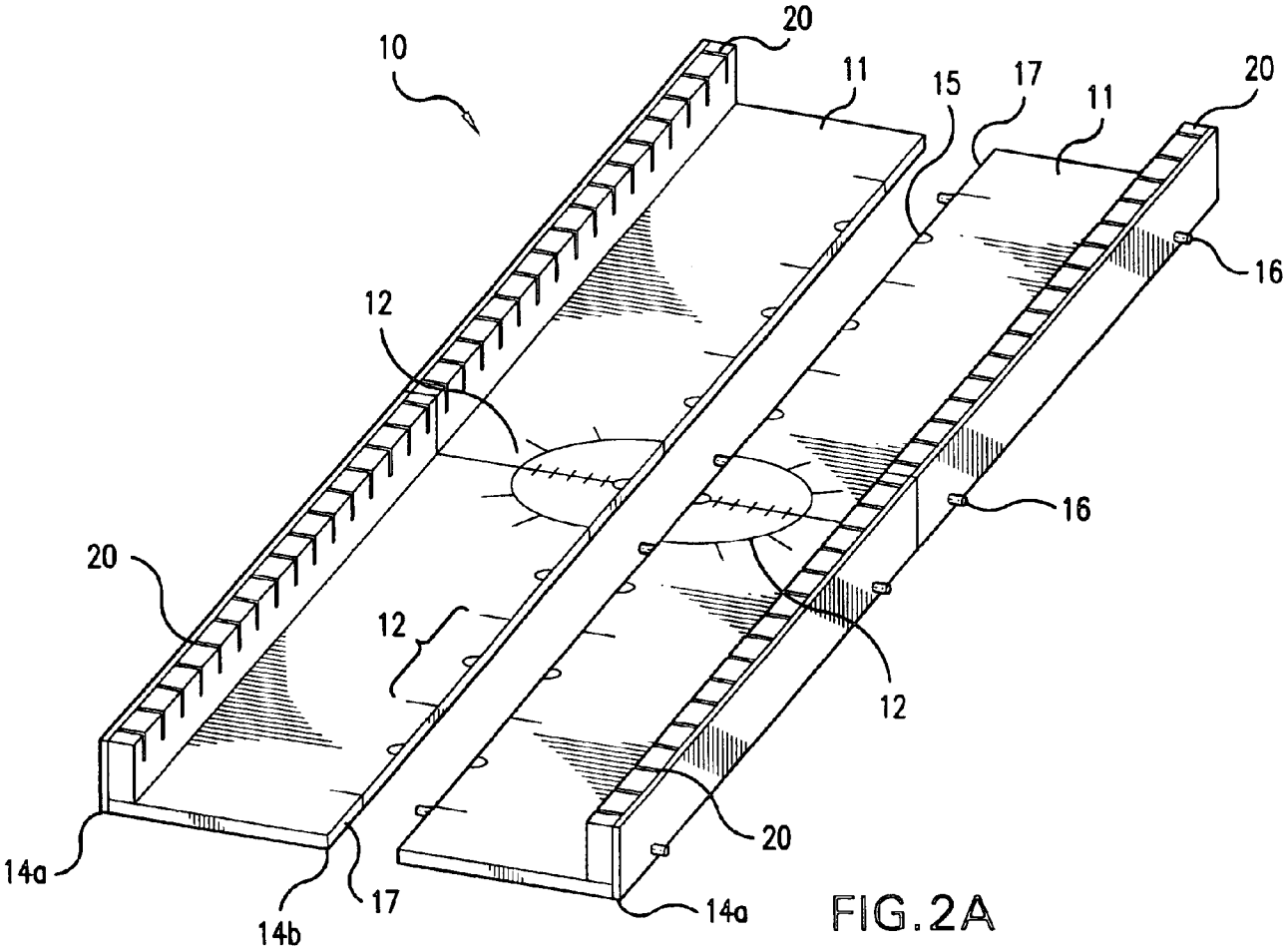
FIG. 2A is an exploded view of the Balance and Gait Training Board without an existing parallel bar system.
Figure 2B:
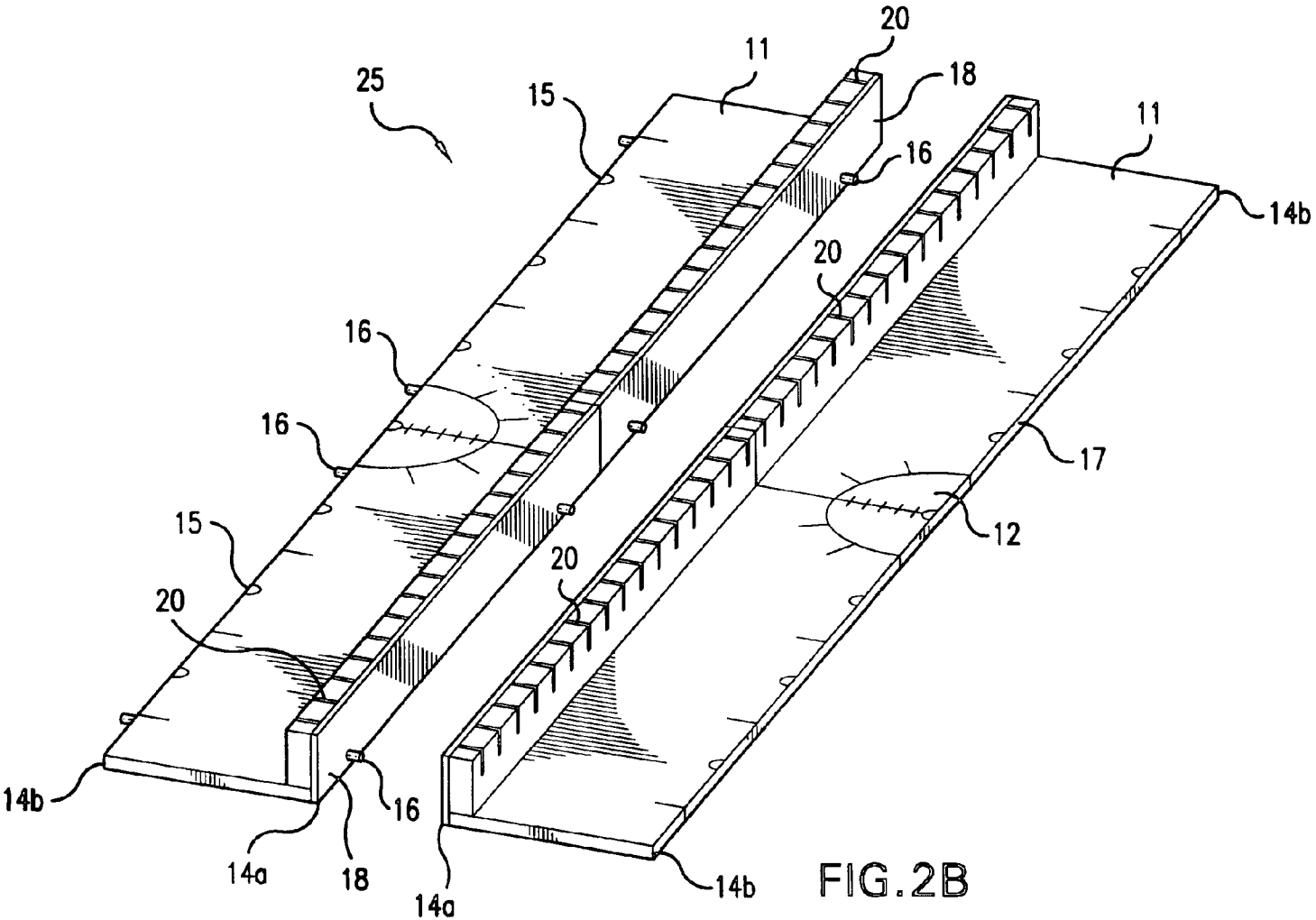
FIG. 2B is an exploded view of the Balance Beam formed without an existing parallel bar system.
Figure 3A:
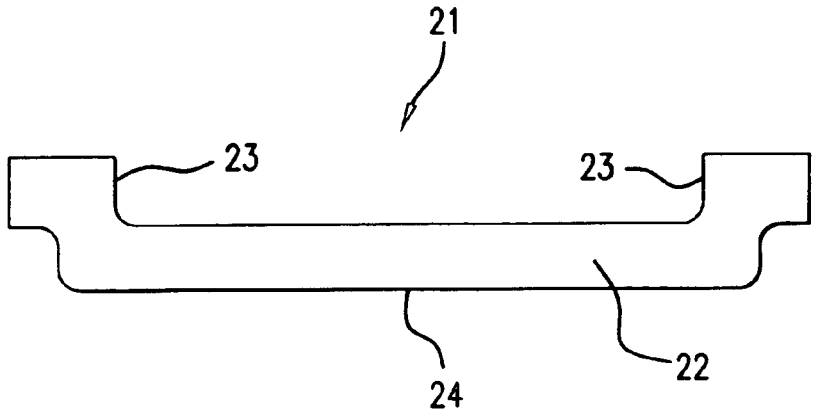
FIG. 3A is a perspective view of a hurdle in the two inch position.
Figure 3B:
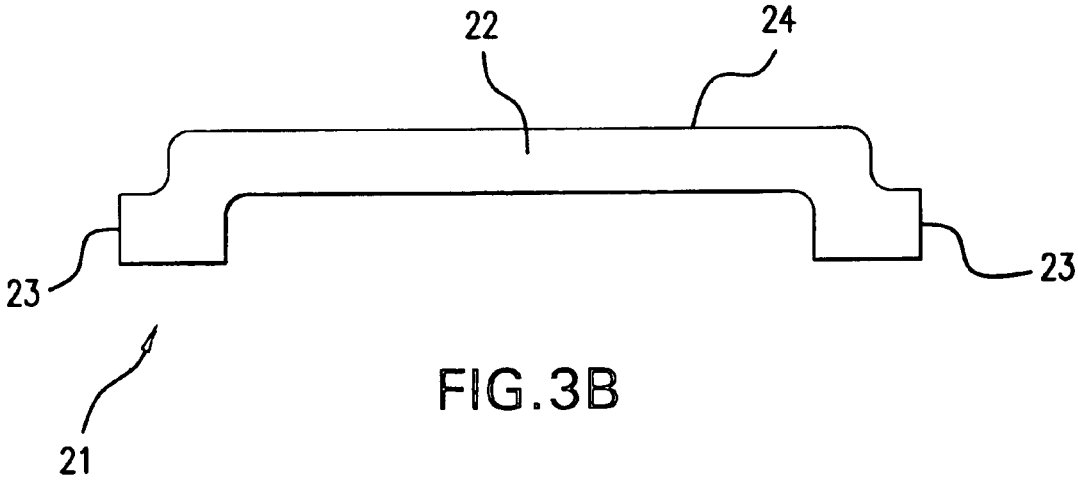
FIG. 3B is a perspective view of a hurdle in the six inch position.

In accordance with an important feature of the present invention, there is shown in FIG. 2A and FIG. 2B, two half sections 11 having a series of openings 15 which forms sockets for receiving a corresponding series of conforming members 16 when the two half sections 11 are aligned and coupled to one another at common planes 17 or at a common planes 18. The conforming members 16 can be a dowel type pin or plug made of any suitable material such as wood, plastic or metal. FIG. 2A shows an exploded view of a unitary board 10 when common planes 17 at inner borders 14*b* of the two half sections 11 are aligned and coupled to one another. FIG. 2B shows an exploded view of a balance beam structure 25 when common planes 18 at outer borders 14*a* of the two half sections 11 are aligned and coupled to one another. As can be seen in FIG. 2A and FIG. 2B, common planes 18 at outer borders 14*a* of the two half sections 11 include the outer surfaces of upstanding walls 13. pull structure and locking structures are mounted on each of the four ends of the upstanding walls 14 of the two half sections 11. The upstanding walls 13 contain a correlating group of equally spaced apart slots 20 on its upper surface. The slots 20 are cut to a partial depth horizontally aligned lengthwise on the upstanding walls 13 for engaging the flappable hurdles 21 depicted in FIG. 3A and FIG. 3B. The slots 20 are typically about 5/16 inches wide and about 1⅝ inches deep and spaced about 3 inches apart. Turning now to FIG. 3A and FIG. 3B wherein the preferred structure of hurdles 21 are illustrated. Each hurdle 21 is an unitary structure having a base portion 22 having curved edges and two flange portions 23 extending upward for a two inch stepping height and extending downward when flipped to adjust the stepping height to six inches. The hurdles 21 are made of durable materials such as polypropylene, polyurethane, PVC and the like.

Figure 4B:
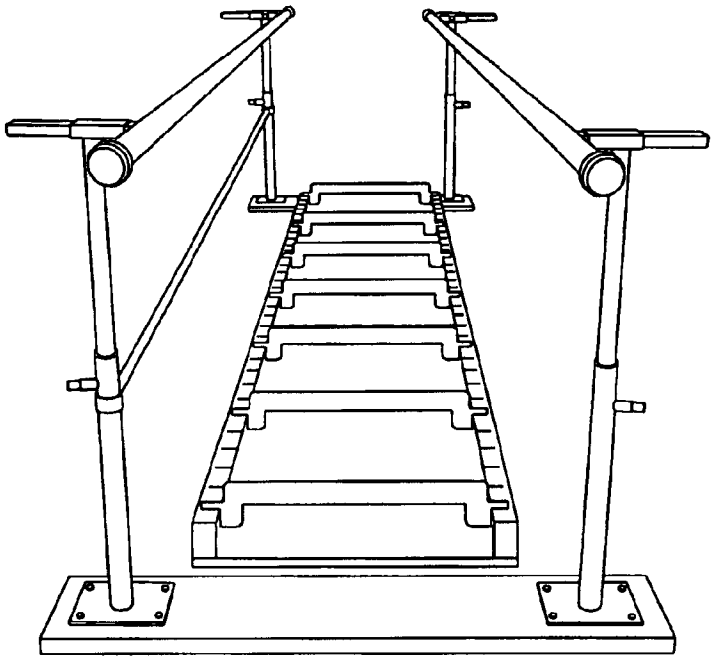
FIG. 4B is a plan view (photocopy) of a hurdle in the six inch position within an existing parallel bar system.
Figure 4A:
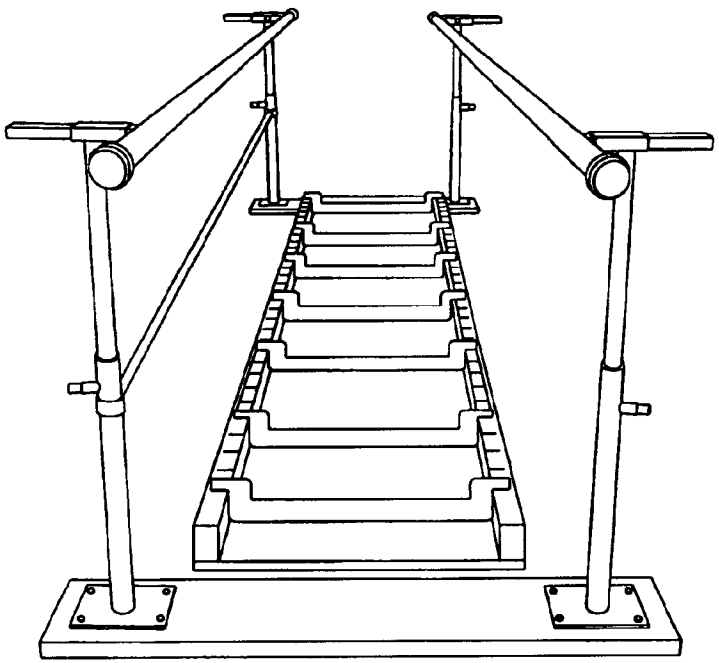
FIG. 4A is a plan view (photocopy) of hurdles of in the two inch position in the embodiment of FIG. 1.

In the present invention, the two half sections 11 are pulled together (aligned) or pulled apart with a free rotation trap-type structure mounted on each end of the four upstanding wall 13. The two half sections 11 are coupled with cooperating locking structures. It is clear that any coupling structures can be used as long as they align and secure the two half sections 11 in dosed position. In carrying out the invention, the balance beam structure 25 is generally 8 feet long 2 inches wide and 3.5 inches high. It is contemplated that the upper surface of the balance beam 25 can be covered, for example, with anti-slip adhesive tape (not shown) to vary the surface texture. The balance beam structure 25 provides a safe efficient and effective surface for training in balance and coordination. The balance beam structure 25 can be used with or without an existing parallel bar system 50. In accordance with one aspect of the invention as shown in FIG. 4A and FIG. 4B, common planes 17 of the two half sections 11 are aligned and coupled to form a unitary board 10 having upstanding walls 13 on its longitudinal outer borders 14*a*. A plurality of ambulation hurdles 21 are positioned securely within predetermined transverse spaced slots 20 as shown in FIG. 4A. When the flange portions 23 of the hurdles 21 are extended upward the base portion 22 is faced downward. When the hurdles 21 are placed in slots 20, the bottom surface 24 of the base portion 22 rests on the platform surface, the height of the hurdles 21 are about two inches tall. Conversely, when the hurdles 21 are flipped upside down, as depicted in FIG. 4B, the flange portion 23 is extended downward and the base portion 22 faces upward. When the hurdles 21 are placed in slots 20 the bottom surface 24 of the base portion 22 extends upward, in the case the height of the hurdles 21 are about six inches tall. Additionally, the step length may be adjusted by simply varying the horizontal positions of the hurdles 21 on upstanding walls 13. The hurdles 21 may be spaced equally or unequally apart. By way of illustration, form a normal walking step height of about two inches, seven hurdles 21 about two inches tall are spaced about fifteen inches apart (every fifth slot 20 after the first slot 20 on upstanding walls 13 on the longitudinal outer border 14*a* of an eight foot board 10). Subsequently, the seven hurdles 21 are flipped upside down, for adjusting the stepping height from about 2 inches to about 6 inches tall, now useful for normal stair or step climbing. This aspect of the present invention also can be used with or without an existing parallel bar system 50.

In keeping with one of the principle objects of the invention, each of the half section 11 may be hinged laterally in the center to allow for folding into quarter sections 26 for example, for compact shipping and storage. The board 10 is portable and adjustable and easily transported and stored which makes it suitable for physical therapy treatment in the home, as well as, in a clinic.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A Balance and Gait Training Board which adapts well within an existing parallel bar system comprising:

a board having a right half section and left half section being symmetrical to each other, each half section having a longitudinal inner border and a longitudinal outer border; said longitudinal outer border having an upstanding wall with predetermined transverse spaced slots on its upper surface for securely positioning flippable hurdles; wherein the longitudinal inner borders of the two half sections are aligned and integrally connected by coupling means to form the board; said board having spaced intervals markings patterned for gait assessment on its upper surface;

a plurality of flappable hurdles which can be positioned and repositioned to adjust the stepping heights and stepping lengths; and wherein said two half sections forming said board are reversed and said longitudinal outer borders of said two half sections are aligned and integrally connected by coupling means to form a balance beam.

2. A Balance and Gait Training Board which adapts well within an existing parallel bar system as claimed in claim 1 wherein said flappable hurdles comprises unitary structures having a base portion having curved edges and having two flange portions extending upward for a two inch stepping height and extending downward for a six inch stepping height.

3. A Balance and Gait Training Board which adapts well within an existing parallel bar system as claimed in claim 1 wherein said stepping heights are adjusted by flipping said hurdles from a two inch position to a six inch position and said stepping lengths are adjusted by repositioning said flippable hurdles horizontally on said longitudinal outer border upstanding walls.

4. A Balance and Gait Training Board which adapts well within an existing parallel bar system as claimed in claim 1 wherein the coupling means comprises a series of openings which form sockets for receiving a corresponding series of conforming members on said longitudinal inner borders and said longitudinal outer borders of said two half sections; and a free rotating pull strap-type structure and a cooperating locking structure mounted on each of the four ends of said longitudinal outer borders upstanding walls of said two half sections.

5. A Balance and Gait Training Board which adapts well within an existing parallel bar system as claim 1 wherein said board and said beam is used with an existing parallel bar system.

6. A Balance and Training Board which adapts well within an existing parallel bar system as claimed in claim 1 wherein said board and said beam is used without an existing bar system.

* * * * *